United States Patent [19]

Tillmanns

[11] 4,077,575

[45] Mar. 7, 1978

[54] SECURING MEANS OF REPLACEABLE WEARING PLATES IN SMASHING MACHINES

[75] Inventor: Josef Tillmanns, Dusseldorf, Germany

[73] Assignee: Lindemann Maschinenfabrik GmbH, Dusseldorf, Germany

[21] Appl. No.: 743,066

[22] Filed: Nov. 18, 1976

Related U.S. Application Data

[63] Continuation-in-part of Ser. No. 544,313, Jan. 27, 1975, abandoned.

[30] Foreign Application Priority Data

Feb. 9, 1974 Germany ..... 2406204

[51] Int. Cl.[2] ..... B02C 13/282

[52] U.S. Cl. ..... 241/285 A; 241/182; 241/285 B; 241/299; 241/300

[58] Field of Search ..... 241/181–183, 241/285 A, 285 B, 294, 299, 300

[56] References Cited

U.S. PATENT DOCUMENTS

| | | | |
|---|---|---|---|
| 971,153 | 9/1910 | Sherrerd | 241/183 |
| 1,921,672 | 8/1933 | Haushalter | 241/183 |
| 2,885,156 | 5/1959 | Fitz et al. | 241/182 |
| 3,378,209 | 4/1968 | Crocheron | 241/182 X |
| 3,473,746 | 10/1969 | Sabel | 241/299 |
| 3,503,564 | 3/1970 | Adam | 241/300 X |
| 3,834,633 | 9/1974 | Dougall et al. | 241/295 |

*Primary Examiner*—Roy Lake
*Assistant Examiner*—Howard N. Goldberg
*Attorney, Agent, or Firm*—Toren, McGeady and Stanger

[57] ABSTRACT

In a material smashing machine, such as a breaking or crushing machine, a housing is provided with at least a portion of its wall lined by a stationary wearing wall against which, in use, the material to be broken or crushed is beaten, ground, or otherwise smashed. The wearing wall is formed, at least in part, by a number of replaceable wearing plates each of which has, on its face adjacent the housing wall, at least one cranked finger which penetrates through a slot in the housing wall and engages with its cranked end the outside of the housing wall to hold the wearing plate against the housing wall. The stability of this fixing can be increased by providing the facing end surfaces of adjacent wearing plates with inter-engaging means including at least one projection on one end surface fitting into a corresponding recess or recesses in the other end surface.

5 Claims, 3 Drawing Figures

P
A
LH
7
2
12
b
9
a
10
11
8
3
14
16
X
1
E
K
4
17
5
6
20
14
18
19
UH

SECURING MEANS OF REPLACEABLE WEARING PLATES IN SMASHING MACHINES

This is a continuation-in-part of application Ser. No. 544,313, filed Jan. 27, 1975, now abandoned.

BACKGROUND OF THE INVENTION

This invention relates to breaking or crushing machines, particularly hammer crushers, which comprise a housing having a stationary wearing wall against which the material to be broken or crushed is beaten, ground or otherwise smashed, usually by hammers mounted on a rotor which revolves within the housing.

The wearing wall is usually composed of a number of individual replaceable wearing plates which are removably fixed on the inside of the housing wall. However, the fixing of the wearing plates on to the housing wall of the machine poses certain problems, because the wearing plates are naturally subject to wear, whereas the fixing means should not be subject to wear. Therefore the most obvious way of fixing, namely screwing the wearing plates to the wall, is generally unsuitable because the screw connections also wear away as the plates wear and thereby lose their holding action.

Attempts have been made to overcome this fixing problem, and one example is disclosed in German Auslegeschrift No. 1,165,975. The solution proposed is, however, not completely satisfactory. In the fixing disclosed, screw connections are indeed avoided. Instead, wedges are used, the wedges being secured to the inner face of the housing wall and engaging in grooves on the inner face of each wearing plate. With this form of construction, the wearing plates mutually support one another, but the supporting action deteriorates with increasing wear of the plates, especially when the portion of the housing wall on which the wearing plates are mounted is curved only slightly or not at all. Consequently, it is not possible in this form of construction to dispense with the fixing wedges. Furthermore, since the processes within a breaking or crushing machine can only be observed from outside with difficulty, it is unavoidable that the wear of the plates, which for economic reasons one naturally wishes to use as long as possible, reaches a degree at which the wedges become released and damaged. In this case it is necessary not only to replace the wearing plates themselves, which is a relatively simple operation, but also to replace the wedges. This can prove difficult because the face of the housing wall remote from the interior of the machine must be accessible for this purpose, a condition which in many cases is not wholly fulfilled.

SUMMARY OF THE INVENTION

According to the present invention, a breaking or crushing machine comprises a housing in which at least a portion of its wall is lined by a stationary wearing wall against which, in use, the material to be broken or crushed is beaten, ground, or otherwise smashed, the wearing wall being formed by a number of replaceable wearing plates each of which has, on its face adjacent the housing wall, at least one cranked finger which penetrates through a slot in the housing wall and engages with its cranked end the outside of the housing wall to hold the wearing plate against the housing wall. With this form of construction, each wearing plate may be worn away without the holding action of the finger being affected until the plate completely disappears, at which point the finger drops away from the outside of the housing. It is then a simple matter to fit a new wearing plate from inside the housing, the finger of the new plate fitting through the appropriate slot in the housing wall and the plate then being moved to engage the cranked end of the finger behind the housing wall adjacent the slot. It is not necessary to have access to the outside of the housing wall in order to fit the wearing plates.

With a construction in accordance with this invention, the fixing of the wearing plates can utilize means providing mutual support between adjacent plates without the disadvantages which occur in the known constructions. Preferably, therefore, adjacent wearing plates are provided with mutually engaging anchoring means at their adjacent end faces. These engaged anchoring means, in conjunction with the action of the fingers, hold each wearing plate at its two opposite ends firmly against radial inward and outward movements. The anchoring means may comprise one or more projections formed on one end face of each wearing plate, and a corresponding recess for receiving each projection in the opposite end face of the adjacent wearing plate.

In order that in every case when the fixing is formed in the preferred manner described above an anchorage of optimum reliability shall be achieved, and to ensure that the fingers engaging outside the housing wall act in conjunction with the anchorages, the finger of each wearing plate is displaced relative to the center of the wearing plate towards one of its ends with anchoring means in such a way that the bent end of the finger points towards the end of the plate nearest the finger.

BRIEF DESCRIPTION OF THE DRAWING

An example of a hammer crusher constructed in accordance with the present invention will now be described with reference to the accompanying drawings, in which.

DETAILED DESCRIPTION OF THE INVENTION

Figure 1:
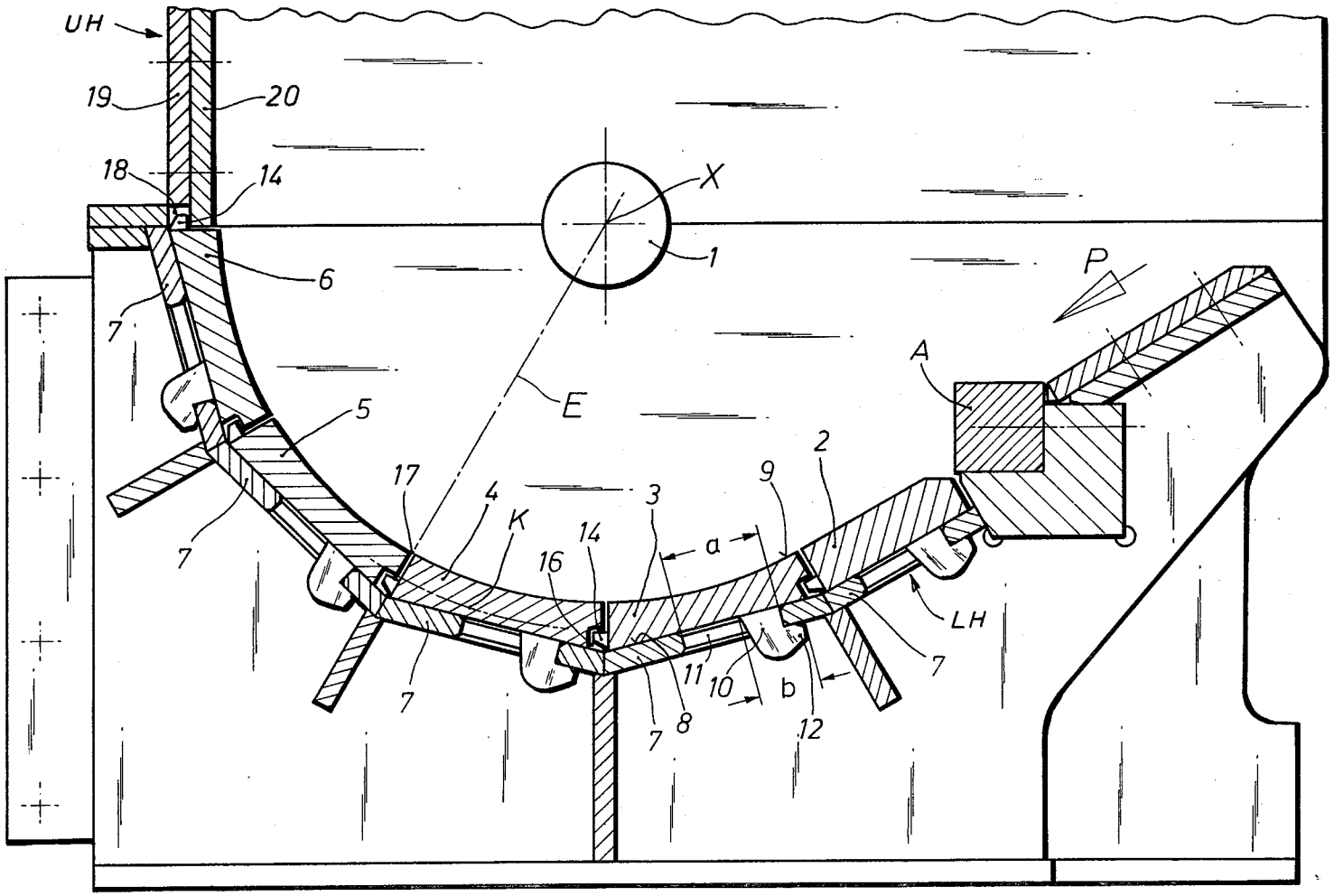
FIG. 1 is a vertical section through the lower part of the hammer crusher.

The hammer crusher is constructed with a polygonal shaped housing, in FIG. 1 the lower half LH of the housing is shown in full while the upper half UH is only partly shown. A number of beating hammers are hinged to a rotor which extends through an opening 1 in the housing and is arranged to be rotated about an axis X. The rotor, its driving mechanism, and the hammers are of conventional construction, and are therefore not shown.

In operation, the material to be crushed is fed into the housing in the direction of arrow P and arrives, over an anvil A, in the vicinity of a wearing wall formed by wearing plates 2 to 6 which are secured to the inside of the lower half of the housing and against which the material is crushed by the hammers. In the example shown, not only is the lower half of the housing wall 7 fitted with wearing plates, but the wall component 19 of the upper half UH is also provided with wearing plates 20. In many cases it is advantageous to extend the region of the housing wall fitted with wearing plates over a larger portion of the circumference of the housing wall.

Except for the first plate 2, i.e. nearest the anvil A, the wearing plates 3–6 are of the same form. Each plate has a plane outer surface 8 with which it bears against the housing wall 7, and a concave inner surface 9. The wearing plates are mounted so that, together, their inner surfaces 9 constitute a part-cylindrical surface which forms the fixed working surface of the hammer crusher and which is centered on the axis X.

Each wearing plate 2–6 is furnished, on its plane outer face 8, with a cranked finger 10. Each finger 10 projects through a slot 11 in the housing wall 7 and engages with its cranked end portion 12 the outside of the housing wall 7. The length *a* of each slot 11 exceeds the corresponding extent *b* of the finger 10, so that the finger can be inserted through the slot from inside the housing. The distance of the cranked end portion 12 of each finger 10 from the outer surface 8 of its wearing plate is, allowing for necessary tolerances, equal to the thickness of the housing wall 7, so that each wearing plate is held against the housing wall 7 only by the finger 10 when the plates are situated in the positions indicated in FIG. 1.

Figure 2:
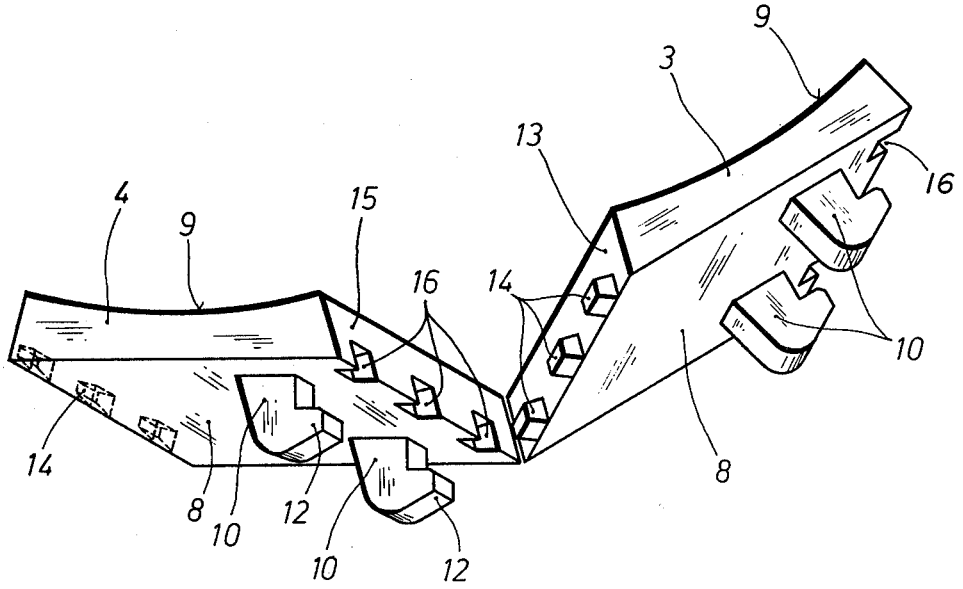
FIG. 2 is a perspective view of two adjacent wearing plates of the crusher, the plates being shown in isolation and angularly displaced from each other to illustrate details of their construction more clearly.

The wearing plates are subjected, in operation, to extraordinarily high stresses, resulting from forces occurring in various directions. The plates are initially firmly held relative to the wall 7 by the fingers 10, but since the wearing plates are components which require frequent replacing and for economic reasons are not manufactured with excessively high accuracy, loosening of the plates under the action of the working stresses is not impossible, in spite of the fingers 10. This is counteracted in the example shown by adjacent plates being also mutually anchored by interengagement with one another. FIG. 2 shows two adjacent wearing plates 3 and 4 before assembly. On one end surface 13 of each plate 3,4 slightly tapering spaced projections 14 are formed, and in its opposite end surface 15 complementary recesses 16 are formed. Thus, the projections 14 on the end surface 13 of the plate 3 will fit into the recesses 16 in the adjacent end surface 15 of the plate 4 when the two plates are located in position as shown in FIG. 1. Other pairs of adjacent plates interengage in the same way. The engagement of these parts is, as is evident, not completely free of play, but this is neither avoidable nor does it do any harm.

In order that the fingers 10 and the anchorages formed by the projections 14 and recesses 16 shall cooperate so that the wearing plates are firmly held with reliability and virtually vibration-free, the fingers 10 of each wearing plate (considered along the the periphery of the wearing surface) are offset from the center of the wearing plate so that they lie as closely as possible to the position at which an anchorage 14,16 with an adjacent wearing plate is situated, the cranked portions 12 of the fingers 10 reaching right up to the end plane of the recesses 16. Each wearing plate is thereby held with a high degree of reliability at both its end faces both against the housing wall 7 and also against the adjacent wearing plate.

Narrow slits 17 naturally remain between the mutually facing end surfaces of adjacent wearing plates, but do not have any adverse effect. The end faces 13 and 15 of the wearing plates may favorably be constructed so that the slits 17 all lie in planes E, which pass through the rotor axis X.

The first plate 2 differs unimportantly from the other wearing plates which are illustrated typically in FIG. 2, in that it does not need to be furnished with recesses 16. On the other hand, the last plate 6 of the wearing wall can be of the same form as the intermediate plates 3 to 5, provided that recesses 18 or a continuous groove for receiving the projections 14 on the plate 6 are provided on the wall component 19 forming a portion of the upper half UH of the housing wall. A wearing plate 20 is secured to the wall component, its attachment is displaced schematically by two broken lines which could be bolts or screws.

Assembly and replacement of the wearing plates is exceedingly simple. Commencing with the first plate 2, the individual wearing plates are inserted from inside the housing with their fingers 10 projecting through the appropriate slots 11, and are slid longitudinally with respect to the slots 11 until the fingers 10 fully engage behind the housing wall and the end faces abut each other, the projections 14 automatically fitting into the corresponding recesses 16. In order that the last plate 6 can be inserted in this manner, the wall component 19 can be tilted or pivoted as shown schematically in FIG. 3. The upper half UH of the housing is pivoted upwardly away from the lower half LH, for example, by a hydraulic cylinder.

In this pivoted position of the upper half, the wearing plates 2-6 can be replaced. When the upper half is pivoted downwardly into the position shown in FIG. 1, the recess 18 locks the projections 14 on the plate 6.

Figure 3:
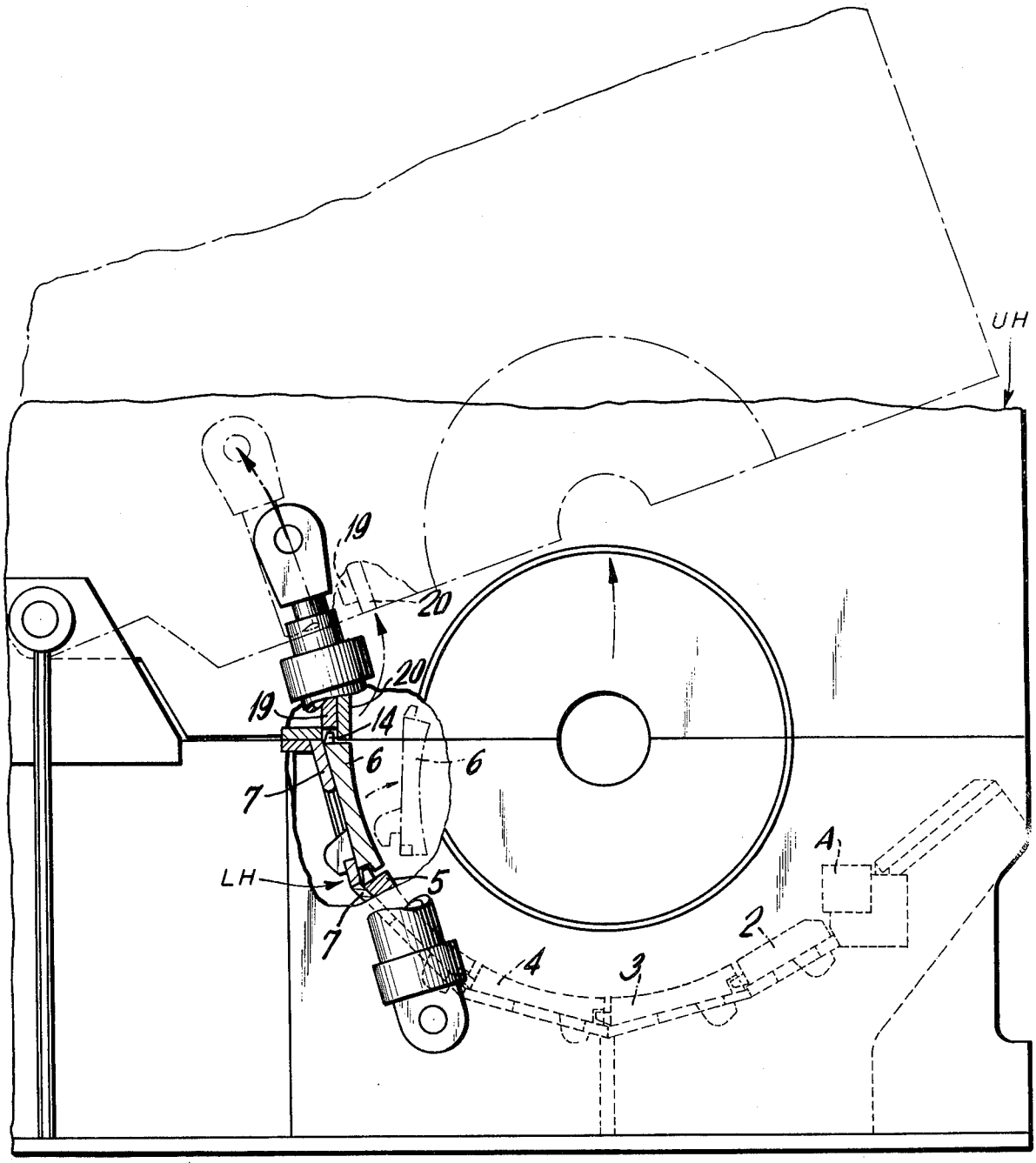
FIG. 3 is a schematic illustration of the hammer crusher showing the upper part pivoted upwardly away from the lower part for effecting replacement of the wearing plates.

While the arrangement shown in FIG. 3 is preferred, it would also be possible to hinge the upper half UH of the housing to the lower half LH on the parting line between the halves and just outwardly from the recess 18 in the lower end of the wall component 19. With this arrangement the upper half of the housing could be pivoted upwardly from the lower half afforcing access for removal and replacement of the last wearing plate 6.

In operation, the wearing plates can be worn away without disadvantage right down to the circular arc K shown in FIG. 1, that is until the wear has reached the recesses 16. Even at this stage, however, the securing of the wearing plates does not immediately collapse, because the fingers 10 are still effective as before. Moreover, when a polygonal housing wall 7 is lined as in FIG. 1, there remains a mutual overlapping of the wearing plates, resulting from the radial orientation of the surfaces 13, 15. The replacing of the wearing plates is carried out simply by removing the plates in reverse to the fitting out described above, and then fitting the new wearing plates. However, even if as a result of inattentiveness by the operator the stage has been passed at which the wear has reached the arc K, and the plates have therefore been completely or almost completely worn away, this becomes apparent in the most clearly recognizable manner when the fingers 10 fall out, again no damage is caused nor is the fitting out with new wearing plates made difficult.

What is claimed is:

1. In a material smashing machine including a housing wall having an inwardly facing and an outwardly facing surface, and a plurality or replaceable wearing plates mounted on said inwardly facing surface, each said wearing plate having an inwardly facing surface, an outwardly facing surface, a first end surface, and a second end surface facing in the opposite direction to said first end surface, said inwardly facing surface of the said wearing plates providing the surface on which the material is smashed, and said outwardly facing surface of said wearing plates being mounted on said inwardly facing surface of said housing wall, the improvement comprising a plurality of cranked fingers extending from said outwardly facing surfaces of said wearing plates, at least one said cranked finger extending from each of said wearing plates, each of said cranked fingers comprising an outwardly extending main portion and an extension projecting at substantially right angles to said main portion toward said first end surface and spaced from the outwardly facing surface for holding contact with said housing wall, a plurality of openings formed in each of certain ones of said first end surfaces of said wearing plates, a plurality of projections formed in each of said second end surfaces of said wearing plates for tight engagement in said plurality of openings, said plurality of openings of one said wearing plate receiving said plurality of projections in an adjacent said wearing plate, and a plurality of slots formed in said housing wall for allowing the passage of said plurality of cranked fingers therethrough, each of said slots having a first end nearer said first end surface of one of said wearing plates and a second end remote from said first end and closer to the second end surface of the one of said wearing plates, each of said cranked fingers being mounted near said first end surface of one of the certain ones of said wearing plates, and having said extension in contact with said outwardly facing surface of said housing wall, whereby said wearing plates are held together and to the housing wall during the smashing of the material.

2. The improvement according to claim 1, comprising three of said plurality of projections in each of said second end surfaces of said wearing plates, and three of said openings in each of said first end surfaces of these wearing plates having said openings.

3. The improvement according to claim 1, wherein each of said wearing plates has two of said cranked fingers extending therefrom.

4. The improvement according to claim 1, wherein each of said extensions comprises an inwardly facing surface and an outwardly facing surface, said inwardly facing surface of said extension contacting said outwardly facing surface of said housing wall for holding a wearing plate thereon.

5. The improvement according to claim 4, wherein in each of said cranked fingers said main portion and said extension are formed integrally, and said extension comprises a tip portion farthest from said main portion, said tip portion being positioned directly beneath said plurality of openings in said wearing plate through which said cranked finger extends.

* * * * *